United States Patent [19]

Sanon

[11] Patent Number: 4,793,617

[45] Date of Patent: Dec. 27, 1988

[54] TENNIS CARD GAME

[76] Inventor: Henry R. Sanon, 150 NW. 106 St., Miami Shores, Fla. 33150

[21] Appl. No.: 80,939

[22] Filed: Aug. 3, 1987

[51] Int. Cl.[4] ..... A63F 1/00

[52] U.S. Cl. ..... 273/298

[58] Field of Search ..... 273/244, 298

[56] References Cited

U.S. PATENT DOCUMENTS

| | | | |
|---|---|---|---|
| 1,289,511 | 12/1918 | Miller | 273/298 |
| 3,949,992 | 4/1976 | Battis | 273/244 |

FOREIGN PATENT DOCUMENTS

| | | | |
|---|---|---|---|
| 2455989 | 1/1981 | France | 273/244 |
| 2569121 | 2/1986 | France | 273/298 |
| 1409750 | 10/1975 | United Kingdom | 273/244 |
| 2164262 | 3/1986 | United Kingdom | 273/298 |

*Primary Examiner*—Carlton R. Croyle
*Assistant Examiner*—Eugene L. Szczecino, Jr.
*Attorney, Agent, or Firm*—Henderson & Sturm

[57] ABSTRACT

The disclosed game provides three decks of playing cards, two decks being identical and each of these two containing cards bearing indicia representative of typical tennis strokes; these decks are "playing" decks and one deck is in possession of each of two players or two teams. The third deck is a "serving" deck and contains cards bearing indicia representative of service conditions; e.g., good, bad, ace, etc. Certain cards may also be designated as "free" cards, capable of being played at the holder's wish. The game is played by one player drawing a serving card and playing it face up on the table. The other player selects a card from a group of eight drawn initially from his "playing " deck and plays it face up. The first player selects from his hand a card that will be a response to the played card and the volley continues. Each time a card is played, that player draws a replacement card from his playing deck.

2 Claims, 2 Drawing Sheets

TENNIS CARD GAME

BACKGROUND AND SUMMARY OF THE INVENTION

Card games of course are well known, as are those based on various sports, among them tennis, as disclosed in the Miller U.S. Pat. No. 1,289,511 in which the various plays are represented by printed instructions on the cards. The Miller game lacks the three decks as well as being deficient in illustrating the various tennis plays in pictorial fashion.

Accordingly, it is an object of the present invention to provide a novel and interesting game involving the use of three decks, two playing decks for the opposing players or teams and a serving deck to be used by the player or team whose turn it is to serve. In the playing decks, the cards include pictorial or graphic illustrations of the court, the net, and the positions of the players and locations of the balls played, thus making it easier and more interesting for the opponent to respond by selecting a suitable card from his hand of playing cards. The rules may be designed to follow those of actual lawn tennis and make possible the simulation of an actual game.

Further features of the invention will become apparent as a preferred embodiment is disclosed in the ensuing description and accompanying sheets of drawings.

DETAILED DESCRIPTION OF A PREFERRED EMBODIMENT OF THE INVENTION

Figure 1:
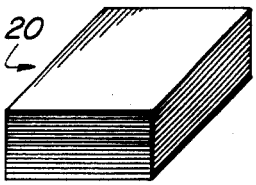
FIG. 1 is a perspective of one of the playing decks.
Figure 2:
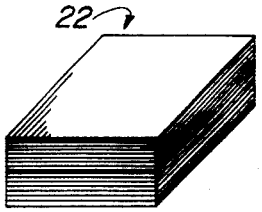
FIG. 2 is a perspective of the other playing deck.
Figure 3:
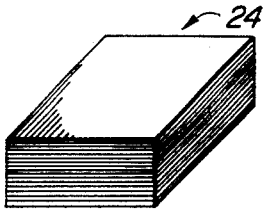
FIG. 3 is a perspective of the serving deck.
Figure 4:
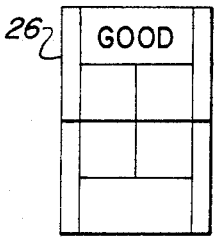
FIGS. 4, 5 and 6 are face views of serving cards marked, respectively, "Good", "Bad" and "Ace".
Figure 5:
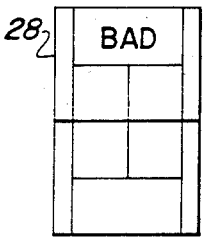
Figure 6:
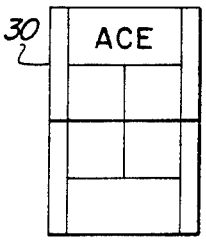
Figure 7:
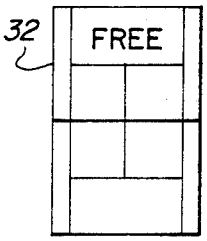
FIG. 7 is a face view of a "Free" card.
Figure 8:
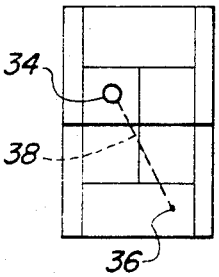
FIGS. 8 through 19 are face views of cards showing the various positions of players and balls played.
Figure 9:
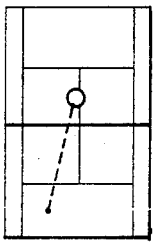
Figure 10:
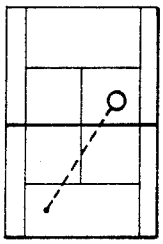
Figure 11:
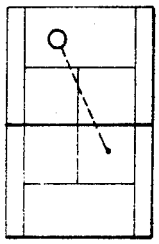
Figure 12:
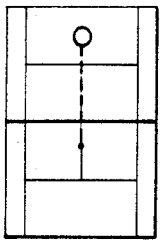
Figure 13:
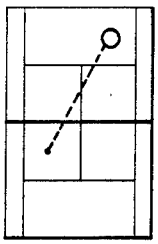
Figure 14:
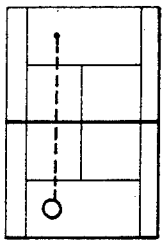
Figure 15:
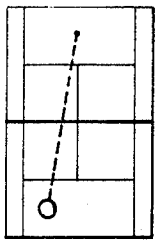
Figure 16:
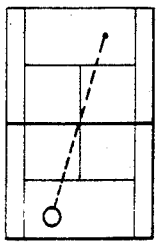
Figure 17:
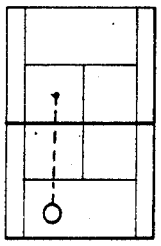
Figure 18:
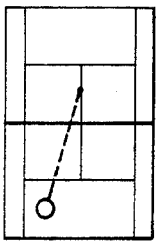
Figure 19:
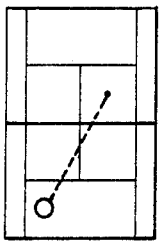

The game comprises essentially two playing decks 20 and 22 and a serving deck 24. The cards in these decks may be of a size and material such as those of conventional playing cards, and the designs on the backs of the cards may be different so as to avoid commingling the cards among the decks; although, these details may be varied. The serving deck contains forty cards of which twenty-six may be "good" cards 26 (FIG. 4), seven "bad" cards 28 (FIG. 5) and seven "ace" cards 30 (FIG. 6). The playing decks are identical, and each contains forty cards, of which thirty-six are playing cards of the types shown in FIGS. 8 through 19 and four may be "free" cards 32 (FIG. 7); although, wide variations are permitted in this area; e.g., certain cards may be identified as "sure shot", i.e., certain winners. The players may agree beforehand which cards are "sure shot" cards, selecting one or more from cards shown in FIGS. 4, 6 and 7. Of the thirty-six "player-ball position" cards (FIGS. 8 through 19), there may be six sets of cards based on the combination of FIGS. 8 through 13 and FIGS. 14 through 19 where different player and ball positions are illustrated respectively. In this respect, it should be noted that the cards should be held by each card player so that the tennis player (circle) is at the bottom; i.e., nearest the card player as shown in FIGS. 12 through 19. In FIGS. 8 through 11, the tennis players are at the tops of the cards but when considering that the card player is across from a player holding cards as in FIGS. 12 through 19, (opponent) the tennis player is nearest the opponent. In any event, each card bears graphic or pictorial indicia representing a net, singles and doubles courts and service areas, all of which should be clear without reference numerals.

In the play of the games, the three decks are shuffled independently and each player selects a playing deck. The choice of serve may be determined by lot, for example. Each player draws eight cards from his playing deck and the server draws a card from the service deck and plays it face up on the table. The other player may respond by playing from his hand a card which "returns" the serve; i.e., a card in which the player, represented by an open circle 34 is in position to strike the serve, which, if good, can be assumed to be in the returner's right-hand fore-court. Alternatively, the player making the good serve can follow this with playing from his hand a playing card such as that of FIG. 16. The responder may respond by playing from his hand a card such as that of FIG. 18. The ball is represented by a solid dot 36 and flight of the ball by a dotted line 38. The volley will continue so long as the players respond to each other with suitable cards. In the example given, the first player responds to the FIG. 18 card by playing a FIG. 9 card, for example, to which the response is a FIG. 14 card, for example. Each time a player plays from his hand, he brings his hand back up to eight cards by drawing from his playing deck. If a player cannot continue a volley, a point is scored for his opponent and a new serving card is drawn and played. Of course, all cards played are played face up and are kept separately so as not to commingle the playing cards from deck to deck. The serving cards are also kept separate from those of the playing decks. The scoring may be as in actual tennis, as may the number of games to a set and so forth. When the playing decks are depleted, they are reshuffled, including cards already played, and the game continues. Playing of the game will be facilitated if each card player holds his cards with the "tennis players" 34 at the bottoms of the cards, or nearest to the card holder.

Playing two "bad" service cards consecutively costs a point and of course the playing of an "ace" card wins a point without more. The "free" and sure shot cards may be played at will if held in hand and the rules may be modified in any suitable manner to award a point, to create a "situation", etc.

Although experience has shown that the game is best played by following the general rules of tennis, different rules may be used according to individual desires. These variations, as well as variations in the card illustrations may be resorted to without departure from the spirit and scope of the invention.

I claim:

1. A plurality of decks of playing cards for playing a game simulating lawn tennis, comprising a serving deck including a plurality of cards bearing indicia indicative of different serving situations; a first playing deck including a plurality of playing cards bearing indicia in the form of a small-scale pictorial illustration of a typical tennis court as seen from above on which are superimposed the representation of a tennis player at one side of the net, a line extended from the player and crossing the net and terminating in a designation of the spot at which the struck ball landed; a second playing deck including a plurality of playing cards identical to those in the first playing deck; and each playing deck includes additional cards bearing indicia representing sure shots that are unreturnable.

2. The invention defined in claim 1, in which at least one of the additional cards represents a free play.

* * * * *